US005862818A

United States Patent [19]

Marinelli

[11] Patent Number: 5,862,818

[45] Date of Patent: Jan. 26, 1999

[54] DISPOSABLE MULTI-SAMPLER AND FITMENT

[75] Inventor: Valeriano Marinelli, Westfield, N.J.

[73] Assignee: FlexPaq Corporation, South Plainfield, N.J.

[21] Appl. No.: 796,809

[22] Filed: Feb. 6, 1997

[51] Int. Cl.[6] ..... A45D 40/18

[52] U.S. Cl. ..... 132/312; 206/581; 206/229; 132/313; 132/317

[58] Field of Search ..... 132/312, 313, 132/218, 317; 401/129, 126; 206/581, 229, 230

[56] References Cited

U.S. PATENT DOCUMENTS

| | | | |
|---|---|---|---|
| 424,539 | 4/1890 | Cole | 401/129 |
| 2,774,093 | 12/1956 | King | 401/130 |
| 4,370,989 | 2/1983 | Taylor | 132/317 |
| 4,403,624 | 9/1983 | Montgomery | 401/129 |
| 4,498,490 | 2/1985 | Seidler | 132/218 |
| 4,711,354 | 12/1987 | Bennett . | |
| 4,732,287 | 3/1988 | Bennett . | |
| 4,786,534 | 11/1988 | Aiken . | |
| 4,889,228 | 12/1989 | Gueret . | |
| 4,952,204 | 8/1990 | Korteweg | 401/129 |
| 4,982,838 | 1/1991 | Fitjer . | |
| 5,109,979 | 5/1992 | Cole . | |
| 5,112,152 | 5/1992 | McBride . | |
| 5,201,809 | 4/1993 | Miura | 132/218 |
| 5,377,874 | 1/1995 | Brown . | |

*Primary Examiner*—Todd E. Manahan
*Assistant Examiner*—Eduardo C. Robert
*Attorney, Agent, or Firm*—Ostrolenk, Faber, Gerb & Soffen, LLP

[57] ABSTRACT

A disposable cosmetics sampler package including a container and a fitment. The fitment includes an applicator held by a handle. The handle is sealed breakably to the fitment. Manipulating the handle breaks the seal and allows the applicator to be used to withdraw a product sample from the container. As the applicator is withdrawn, a metering device inside the fitment scrapes excess material off of the applicator. The handle can accept various types of applicators including mascara brushes, lip gloss paddles, and lip coloring brushes. Similarly, metering devices are interchangeable during manufacture to accommodate the type of applicator selected to dispense the product to be sampled.

6 Claims, 4 Drawing Sheets

DISPOSABLE MULTI-SAMPLER AND FITMENT

BACKGROUND OF THE INVENTION

1. Field of the Invention

The present invention relates to disposable sampling packages. More specifically, the present invention relates to disposable packages for sampling cosmetic products such as mascara, eye liner, blush, and lip coloring and gloss.

2. Description of the Related Art

Single-use packaging for sampling cosmetic products is desirable both to consumers and marketers. Such packages provide a convenient and economical way for products to be tested by potential customers prior to purchase. Further, single-use packages are desirable for sanitation reasons, especially in the area of cosmetic products that are applied to the body. In addition, sample packaging can be distributed to potential customers in a variety of ways, including point-of-sale, mail delivery, package inserts, and publication inserts, for example.

A sampling package should be capable of being opened easily by the consumer, while providing a sturdy package able to withstand the rigors of worldwide product distribution. Moreover, when dispensing a cosmetic product, it is desirable to provide the sample container with a metering device to assist the consumer in applying the correct amount of material.

In addition, it is desirable to provide a package that can be used and disposed of easily and conveniently. Accordingly, the opened package should present a minimum number of pieces, simplifying both use and disposal. Moreover, the pieces should be capable of being handled and discarded by the consumer without the consumer soiling his or her hands or the surrounding area.

Economy is a primary concern for sample packaging. The materials of the sampler should be inexpensive and readily available. In addition, manufacturing of the sampler should be inexpensive. Also, the package design should be flexible so that various types of consumer products can be dispensed into and by the sampler package.

Disposable sampling packages have been developed for various products, including foods and cosmetics. Cosmetic samplers include, for example, U.S. Pat. Nos. 5,109,979 to Cole; 5,112,152 to McBride; 4,982,838 to Fitjer; 4,889,228 to Gueret; 4,786,534 to Aiken; and 4,732,287 and 4,711,354 to Bennett. U.S. Pat. No. 5,377,874 to Brown discloses a sampler for food.

Many of the known samplers are too expensive to produce economically for practical application as a single-use sampler. Further, known samplers utilize packaging designs that are not easily adapted to various types of consumer products. Moreover, the known packages often have extraneous parts that must be removed and that may have excess product on them, reducing their ease of use and presenting a potential soiling hazard to the consumer and the surrounding area. In addition, the known packages often are not easily manufactured, which increases production costs, a critical factor in producing a disposable sampler.

SUMMARY OF THE INVENTION

The present invention overcomes the problems of the prior art, such as those noted above, by providing a disposable cosmetic sampler having a container for holding a cosmetic product, an interchangeable applicator extending into the open end of the container, and an interchangeable metering device cooperating with the applicator. The applicator can be one of several types, including, for example, brushes, paddles, and soft-tipped applicators.

The container preferably is an open-ended paquette. A fitment is provided for sealing the open end of the paquette, enclosing a sample product within the paquette. The fitment includes a collar having wings for positioning, sealing, and attaching the collar to the paquette. The fitment also includes a handle that attaches to the selected applicator.

A breakable seal is formed in the fitment between the handle and the collar. Advantageously, the seal is manually breakable by the consumer for opening the sampling package and separating the handle from the collar.

The metering device preferably is disposed in the collar and surrounds the applicator. The metering device removes excess product from the applicator as the applicator is withdrawn from the paquette through the fitment collar. According to a preferred embodiment, the metering device is a separate piece that couples with the collar, preferably by snapping into place, and can be selected from a variety of different metering devices depending on the type of applicator selected for use in the sampler.

Other features and advantages of the present invention will become apparent from the following description of the invention which refers to the accompanying drawings.

DETAILED DESCRIPTION OF THE PREFERRED EMBODIMENTS

Figure 1:
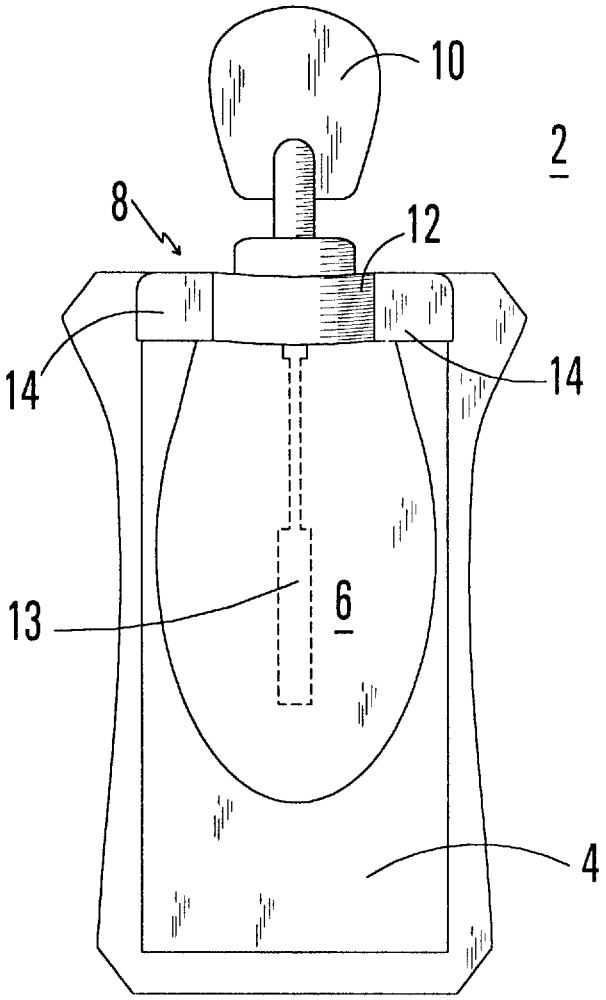
FIG. 1 is a front view of a disposable cosmetic sampler according to the present invention.

Referring initially to FIG. 1, a disposable cosmetic sampler 2 according to the present invention includes a container in the form of a paquette 4. Paquette 4 is made of multi-layer film sealed on three sides and having an open end. Sample material 6, for example, lip gloss, is disposed inside the paquette. The paquette is sealed by a known method such as heat sealing, sonic welding, or gluing.

The open end of paquette 4 is sealed with a separate fitment 8. Fitment 8 includes a handle 10 and a collar 12. An applicator, such as paddle 13, reaches into the sample material. Two wings 14 extending from either side of the collar assist in positioning and centering the fitment within the open end of the paquette. Advantageously, the wings preferably are thin to assist in sealing the collar to the container, as described below.

Paquette 4 and fitment 8 preferably are formed of low density polyethylene. Although the two pieces need not be made of the same type of plastic, it is preferred that the plastics be the same or very similar so that they have similar thermoplastic properties. As noted above, the wings are also quite thin, approaching the thickness of the paquette material. Accordingly, the two pieces will behave similarly and provide a good seal as the sampler goes through heat and dwell during the preferred method of manufacturing the paquette. Other preferred thermoplastics include, without limitation, polypropylene and high density polyethylene.

During manufacture, the thin wings 14 are received into the opening of paquette 4. Wings 14 become sandwiched between the front and back walls of the paquette 4. Accordingly, as heat is applied to seal the fitment to the paquette, the thin wings heat quickly, assisting in forming a small, rapid, positive seal.

The materials used for the paquette must be compatible with the material to be placed inside the paquette or other container. In addition, the material and the seals used to construct the sampler must be impervious to germs and other contaminants that may injure the consumer or be detrimental to the product inside the container. Accordingly, alternative multi-layer paquette/container embodiments can include an outside layer as an environmental sealing layer, and an inside layer of a foil compatible with the product inside.

Figure 2:
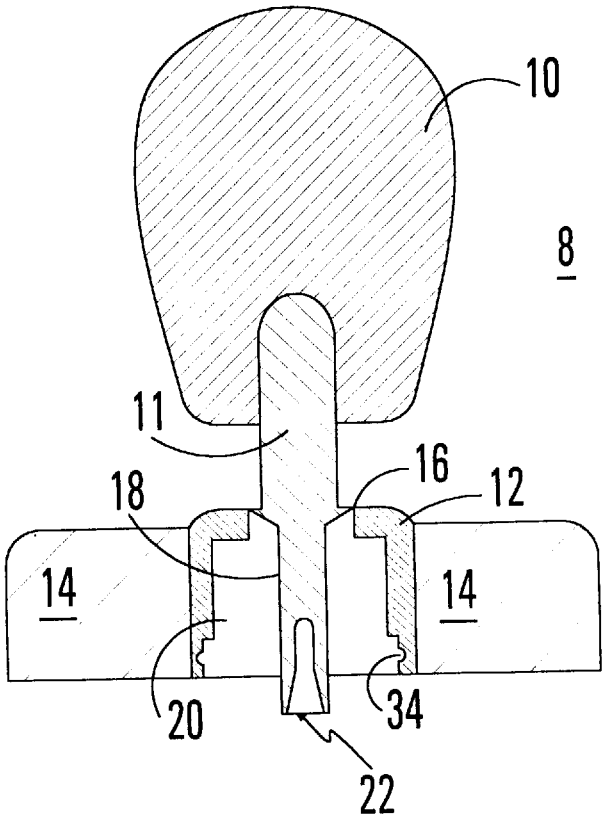
FIG. 2 is an elevation of a collar and handle unit of a fitment according to the present invention.
Figure 3:
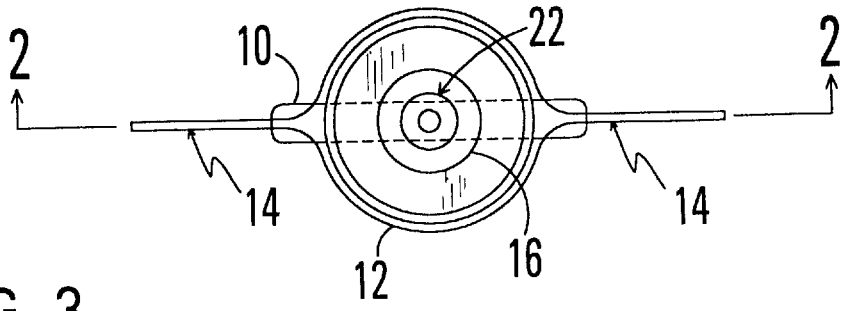
FIG. 3 is a bottom view of the collar and handle unit of FIG. 2.

Referring next to FIGS. 2 and 3, the fitment 8 of the present invention will be described in greater detail. FIG. 2 is a partial cut-away elevation of fitment 8 showing handle 10 sealed to collar 12 by a thin, annular seal 16. Annular seal 16, also shown in FIG. 3, is designed as a breakable seal. Accordingly, fitment 8 is molded as a single piece, whereby seal 16 is provided as a very thin area of thermoplastic. As a result, the seal can be broken by twisting handle 10 with respect to collar 12, as described further below in connection with FIG. 6.

Handle 10 has a shaft 11 that extends to form a brush handle extension 18 disposed within central bore 20 of fitment collar 12. Extension 18 has a socket or aperture 22 into which various applicators can be inserted. The applicator preferably is press-fit into aperture 22 of the handle. Alternatively, the applicator can be held within the handle by securing methods known in the art, including, for example, threading, glue, heat sealing, and sonic sealing. Aperture 22 has a flared opening to assist in insertion of the applicator.

Figure 4:
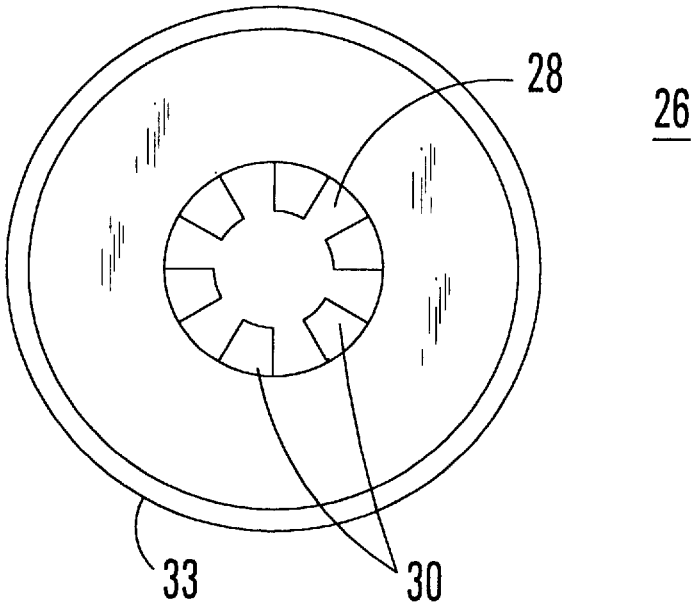
FIG. 4 is an elevation of a metering device according to the present invention.
Figure 5:
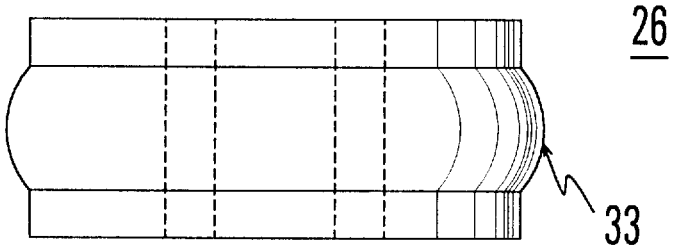
FIG. 5 is a bottom view of the metering device of FIG. 4.

Referring next to FIGS. 4 and 5, a metering device 26 according to the present invention is shown enlarged with respect to fitment 8 of FIGS. 2 and 3. Metering device 26 is an annulus having a central through-opening 28. Central opening 28 is surrounded by flexible fins 30 directed inwardly. The fins serve to remove excess material from an applicator, particularly a mascara brush 32, such as that shown in FIG. 6. When using an applicator such as paddle 13 (FIG. 1), fins 30 are optional.

As the applicator brush 32 is withdrawn by the consumer from the container, the brush passes through metering device 26. Accordingly, an amount of excess material held by the brush is scraped away by flexible fins 30 and remains inside the paquette. Fins 30 are spaced apart and are flexible enough that a sufficient amount of product material remains on the brush to satisfy the sampling needs of the potential customer.

Referring more particularly to FIG. 5, metering device 26 is shown in elevation. Advantageously, metering device 26 is interchangeable with other types of metering devices having a shape and a design optimized to cooperate with the type of applicator selected for use in the sampling device. According to a preferred embodiment, metering device 26 has an annular bead 32. Bead 33 cooperates with a corresponding annular groove 34 inside collar 12 of fitment 8 to allow metering device 26 to be snapped into place within fitment 8. Accordingly, samplers for a wide variety of products can be manufactured using very similar manufacturing apparatus and processes.

When metering device 26 is received within fitment 8, the central opening of metering device 26 is at least partially or completely occluded by handle extension 18. As a result, sample material 6 held within paquette 4 is prevented from flowing out into the central bore 20 of collar 12. Consequently, seal 16 is less likely to be ruptured, for example, by sample material being forced out through the fitment during shipment or handling of the sampler. In addition, a build-up of sample material is prevented inside the fitment and along the shaft of the handle and applicator, which otherwise could drip off or fall out unexpectedly, soiling the potential customer or the surrounding sampling area.

Figure 6:
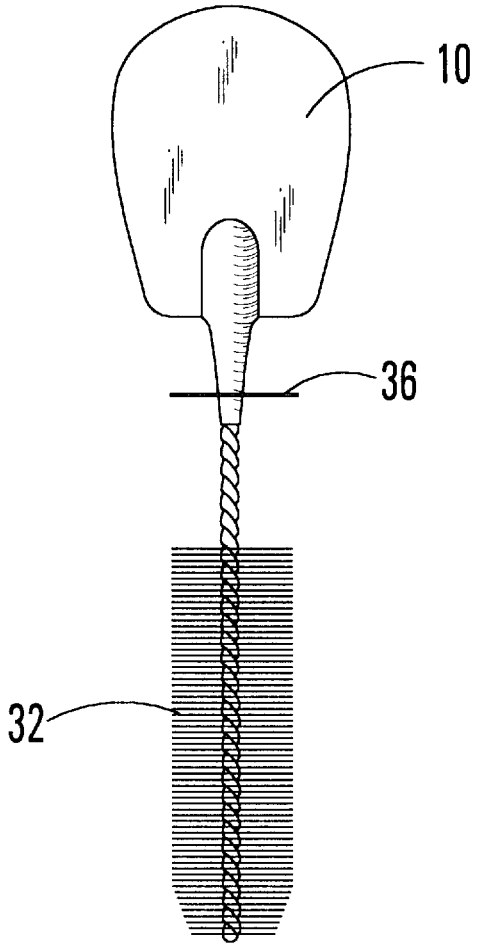
FIG. 6 shows the separated handle section of the collar and handle unit of FIG. 2.
Figure 7:
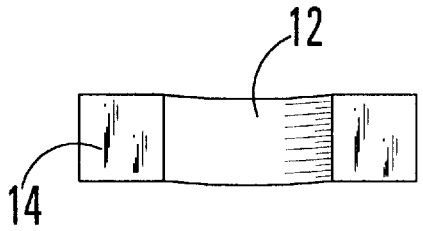
FIG. 7 shows the separated collar section of the collar and handle unit of FIG. 2.

FIGS. 6 and 7 illustrate separation by the consumer of the fitment into separate sections. In FIG. 6, fitment 8 with mascara brush is disposed in handle 10. Seal 16 has been broken by manual manipulation or twisting of the handle with respect to the fitment collar shown in FIG. 7, separating the originally-unitary fitment 8 into a handle section and a collar section. The broken edge of seal 16 is indicated at 36.

Although the present invention has been described in relation to particular embodiments thereof, many other variations and modifications and other uses will become apparent to those skilled in the art. Therefore, the present invention is to be limited not by the specific disclosure herein, but only by the appended claims.

What is claimed is:

1. A disposable cosmetic sampler comprising:

a paquette container for holding a cosmetic product, the container having a front wall, a back wall, and an open end;

an applicator extending into the container;

a fitment sealing the open end of the container, the fitment comprising:

a collar attached to the container, the collar having a pair of flat wings extending from either side of the collar and positioned within the opening of the container, sandwiched between the front and back walls of the container, for positioning and for attaching the collar to the container;

a handle coupled to the applicator; and a seal between the handle and the collar, the seal being breakable manually for separating the handle from the collar; and a metering device disposed in the collar and around at least a portion of the applicator.

2. The cosmetic sampler of claim 1, wherein the metering device is disposed interchangeably in the collar.

3. The disposable cosmetic sampler of claim 1, wherein the container is a multi-layer film paquette.

4. A fitment for a disposable cosmetic sampler container having a front wall, a back wall, and an open end, the fitment comprising:

a collar having:

a pair of flat wings extending from either side of the collar for positioning the collar within the open end of the sampler container and for attachment of the collar to the container;

a handle; and a seal disposed annularly around the handle and coupling the handle to the collar, the seal being breakable by manual pressure for separating the handle from the collar.

5. The fitment of claim 4, further comprising an applicator coupled with the handle.

6. The fitment of claim 5, further comprising a metering device disposed within the collar and around the applicator for removing excess cosmetic disposed on the applicator.

* * * * *